US005945777A

United States Patent [19]

Janning et al.

[11] Patent Number: 5,945,777

[45] Date of Patent: Aug. 31, 1999

[54] SURFACE CONDUCTION EMITTERS FOR USE IN FIELD EMISSION DISPLAY DEVICES

[75] Inventors: John L. Janning; Robert L. Clark, both of Dayton, Ohio

[73] Assignee: St. Clair Intellectual Property Consultants, Inc., Grosse Pointe, Mich.

[21] Appl. No.: 09/070,611

[22] Filed: Apr. 30, 1998

[51] Int. Cl.[6] ..... H01J 1/62

[52] U.S. Cl. ..... 313/310; 313/495

[58] Field of Search ..... 313/309, 336, 313/351, 495, 310; 315/169.1; 445/24, 50

[56] References Cited

U.S. PATENT DOCUMENTS

| | | | |
|---|---|---|---|
| 5,023,110 | 6/1991 | Nomura et al. . | |
| 5,329,207 | 7/1994 | Cathey et al. | 313/309 |
| 5,378,182 | 1/1995 | Liu | 445/24 |
| 5,679,043 | 10/1997 | Kumar . | |
| 5,686,791 | 11/1997 | Kumar et al. . | |

*Primary Examiner*—Vip Patel
*Attorney, Agent, or Firm*—Harness, Dickey & Pierce, P.L.C.

[57] ABSTRACT

For use in cathodoluminescent field emission display devices, a gated channel layer of an inverted field effect transistor functions as the electron emissive layer for a flat film surface conduction cathode emitter. In such emitters, electrons are emitted from the surface of a flat thin emissive film when an electric current is caused to flow through the film in parallel with the surface of the film. An electric field caused by a variable voltage source being applied to the gate of the transistor can control the conductivity of the channel layer, thereby controlling the level of electron emissions from the cathode emitter structure. In a variation, the field effect transistor is constructed with a two-tier structure that during operation is designed to keep conduction near the surface of the transistor. As a result, this device pushes electrons towards the exposed surface where they can then escape from the channel layer to bombard the cathodoluminescent phosphor anode. To ensure against unwanted anode currents, electron blocking junction elements can be incorporated on either side or both sides of the channel and positioned over a widened gate electrode, such that they are commonly gated along with the channel to respond to a single control voltage input to the gate electrode. Further, such emitter structures can incorporate a thin near monomolecular film of a high secondary electron emission material on the surface of the electron emissive layer, to generally enhance the level of electron emissions from the emitter.

59 Claims, 3 Drawing Sheets

SURFACE CONDUCTION EMITTERS FOR USE IN FIELD EMISSION DISPLAY DEVICES

This invention relates to electronic field emission display (FED) devices, such as matrix-addressed monochrome and full color flat panel displays in which light is produced by using cold-cathode electron field emissions to excite cathodoluminescent material, and in particular to flat film surface conduction cathode emitters for use in a field emission display device. Such display devices use electric fields to induce electron emissions, as opposed to elevated temperatures or thermionic cathodes as used in cathode ray tubes. In a surface conduction cathode emitter, electrons are emitted from the surface of a flat thin film of small area when an electric current is caused to flow through the film in parallel with the surface of the film. An electric extraction field potential, which may be the anode to cathode electron acceleration potential in an FED, is applied to produce emission of a percentage of the electrons from the current flowing through the film, which can be on the order of about 100 Angstroms thick for these types of emitters.

BACKGROUND OF THE INVENTION

Cathode ray tube (CRT) designs have been the predominant display technology, to date, for purposes such as home television and desktop computing applications. CRTs have drawbacks such as excessive bulk and weight, fragility, power and voltage requirements, electromagnetic emissions, the need for implosion and X-ray protection, analog device characteristics, and an unsupported vacuum envelope that limits screen size. However, for many applications, including the two just mentioned, CRTs have present advantages in terms of superior color resolution, contrast and brightness, wide viewing angles, fast response times, and low cost of manufacturing.

To address the inherent drawbacks of CRTs, such as lack of portability, alternative flat panel display design technologies have been developed. These include liquid crystal displays (LCDs), both passive and active matrix, electroluminescent displays (ELDs), plasma display panels (PDPs), and vacuum fluorescent displays (VFDs). While such flat panel displays have inherently superior packaging, the CRT still has optical characteristics that are superior to most observers. Each of these flat panel display technologies has its unique set of advantages and disadvantages, as will be briefly described.

The passive matrix liquid crystal display (PM-LCD) was one of the first commercially viable flat panel technologies, and is characterized by a low manufacturing cost and good x-y addressability. Essentially, the PM-LCD is a spatially addressable light filter that selectively polarizes light to provide a viewable image. The light source may be reflected ambient light, which results in low brightness and poor color control, or back lighting can be used, resulting in higher manufacturing costs, added bulk, and higher power consumption. PM-LCDs generally have comparatively slow response times, narrow viewing angles, a restricted dynamic range for color and gray scales, and sensitivity to pressure and ambient temperatures. Another issue is operating efficiency, given that at least half of the source light is generally lost in the basic polarization process, even before any filtering takes place. When back lighting is provided, the display continuously uses power at the maximum rate while the display is on.

Active matrix liquid crystal displays (AM-LCDs) are currently the technology of choice for portable computing applications. AM-LCDs are characterized by having one or more transistors at each of the display's pixel locations to increase the dynamic range of color and gray scales at each addressable point, and to provide for faster response times and refresh rates. Otherwise, AM-LCDs generally have the same disadvantages as PM-LCDs. In addition, if any AM-LCD transistors fail, the associated display pixels become inoperative. Particularly in the case of larger high resolution AM-LCDs, yield problems contribute to a very high manufacturing cost.

AM-LCDs are currently in widespread use in laptop computers and camcorder and camera displays, not because of superior technology, but because alternative low cost, efficient and bright flat panel displays are not yet available. The back lighted color AM-LCD is only about 3 to 5% efficient. The real niche for LCDs lies in watches, calculators and reflective displays. It is by no means a low cost and efficient display when it comes to high brightness full color applications.

Electroluminescent displays (ELDs) differ from LCDs in that they are not light filters. Instead, they create light from the excitation of phosphor dots using an electric field typically provided in the form of an applied AC voltage. An ELD generally consists of a thin-film electroluminescent phosphor layer sandwiched between transparent dielectric layers and a matrix of row and column electrodes on a glass substrate. The voltage is applied across an addressed phosphor dot until the phosphor "breaks down" electrically and becomes conductive. The resulting "hot" electrons resulting from this breakdown current excite the phosphor into emitting light.

ELDs are well suited for military applications since they generally provide good brightness and contrast, a very wide viewing angle, and a low sensitivity to shock and ambient temperature variations. Drawbacks are that ELDs are highly capacitive, which limits response times and refresh rates, and that obtaining a high dynamic range in brightness and gray scales is fundamentally difficult. ELDs are also not very efficient, particularly in the blue light region, which requires rather high energy "hot" electrons for light emissions. In an ELD, electron energies can be controlled only by controlling the current that flows after the phosphor is excited. A full color ELD having adequate brightness would require a tailoring of electron energy distributions to match the different phosphor excitation states that exist, which is a concept that remains to be demonstrated.

Plasma display panels (PDPs) create light through the excitation of a gaseous medium such as neon sandwiched between two plates patterned with conductors for x-y addressability. As with ELDs, the only way to control excitation energies is by controlling the current that flows after the excitation medium breakdown. DC as well as AC voltages can be used to drive the displays, although AC driven PDPs exhibit better properties. The emitted light can be viewed directly, as is the case with the red-orange PDP family. If significant UV is emitted, it can be used to excite phosphors for a full color display in which a phosphor pattern is applied to the surface of one of the encapsulating plates. Because there is nothing to upwardly limit the size of a PDP, the technology is seen as promising for large screen television or HDTV applications. Drawbacks are that the minimum pixel size is limited in a PDP, given the minimum volume requirement of gas needed for sufficient brightness, and that the spatial resolution is limited based on the pixels being three-dimensional and their light output being omnidirectional. A limited dynamic range and "cross talk" between neighboring pixels are associated issues.

Vacuum fluorescent displays (VFDs), like CRTs, use cathodoluminescence, vacuum phosphors, and thermionic cathodes. Unlike CRTs, to emit electrons a VFD cathode comprises a series of hot wires, in effect a virtual large area cathode, as opposed to the single electron gun used in a CRT. Emitted electrons can be accelerated through, or repelled from, a series of x and y addressable grids stacked one on top of the other to create a three dimensional addressing scheme. Character-based VFDs are very inexpensive and widely used in radios, microwave ovens, and automotive dashboard instrumentation. These displays typically use low voltage ZnO phosphors that have significant output and acceptable efficiency using 10 volt excitation.

A drawback to such VFDs is that low voltage phosphors are under development but do not currently exist to provide the spectrum required for a full color display. The color vacuum phosphors developed for the high-voltage CRT market are sulfur based. When electrons strike these sulfur based phosphors, a small quantity of the phosphor decomposes, shortening the phosphor lifetimes and creating sulfur bearing gases that can poison the thermionic cathodes used in a VFD. Further, the VFD thermionic cathodes generally have emission current densities that are not sufficient for use in high brightness flat panel displays with high voltage phosphors.

Another and more general drawback is that the entire electron source must be left on all the time while the display is activated, resulting in low power efficiencies particularly in large area VFDs.

Against this background, field emission displays (FEDs) potentially offer great promise as an alternative flat panel technology, with advantages which would include low cost of manufacturing as well as the superior optical characteristics generally associated with the traditional CRT technology. Like CRTs, FEDs are phosphor based and rely on cathodoluminescence as a principle of operation. High voltage sulfur based phosphors can be used, as well as low voltage phosphors when they become available.

Unlike CRTs, FEDs rely on electric field or voltage induced, rather than temperature induced, emissions to excite the phosphors by electron bombardment. To produce these emissions, FEDs have generally used a multiplicity of x-y addressable cold cathode emitters. There are a variety of designs such as point emitters (also called cone, microtip or "Spindt" emitters), wedge emitters, thin film amorphic diamond emitters or thin film edge emitters, in which requisite electric fields can be achieved at lower voltage levels.

Each FED emitter is typically a miniature electron gun of micron dimensions. When a sufficient voltage is applied between the emitter tip or edge and an adjacent gate, electrons are emitted from the emitter. The emitters are biased as cathodes within the device and emitted electrons are then accelerated to bombard a phosphor generally applied to an anode surface. Generally, the anode is a transparent electrically conductive layer such as indium tin oxide (ITO) applied to the inside surface of a faceplate, as in a CRT, although other designs have been reported. For example, phosphors have been applied to an insulative substrate adjacent the gate electrodes which form apertures encircling microtip emitter points. Emitted electrons move upwardly through the apertures and strike phosphor areas.

FEDs are generally energy efficient since they are electrostatic devices that require no heat or energy when they are off. When they operate, nearly all of the emitted electron energy is dissipated on phosphor bombardment and the creation of emitted unfiltered visible light. Both the number of exciting electrons (the current) and the exciting electron energy (the voltage) can be independently adjusted for maximum power and light output efficiency. FEDs have the further advantage that each pixel can be operated by its own array of emitters activated in parallel to minimize electronic noise and provide redundancy, so that if one emitter fails the pixel still operates satisfactorily. Another advantage of FED structures is their inherently low emitter capacitance, allowing for fast response times and refresh rates. Field emitter arrays are in effect, instantaneous response, high spatial resolution, x-y addressable, area-distributed electron sources unlike those in other flat panel display designs.

Due to the inherent problems, notably the expense of manufacture, associated with microtip or "Spindt" type emitters, recent developments in the area of FEDs have focused on flat surface emitters. In particular, some work is being done in the area of surface conduction electron emitters. In a surface conduction cathode emitter, electrons are emitted from the surface of a flat thin film of small area when an electric current is caused to flow through the film in parallel with the surface of the film. An electric extraction field potential, which may be the anode to cathode electron acceleration potential in an FED, is applied to produce emission of a percentage of the electrons from the current flowing through the film. Generally, to enhance this manner of operation, surface conduction emitter films are fabricated with structural discontinuities such as material interfaces, cracks or fissures to provide dislocation sites at which electron emissions can be generated. For example, U.S. Pat. No. 5,023,110 discloses surface conduction emitters in which the conductive film is formed from a dispersion of fine particles heat treated in situ by an "electroforming" process in which an electric current is passed through the film to produce Joule heat. In this process, an applied voltage is ramped up over time, e.g., to 14 V at a rate of 1 V per minute, to produce a "spatially discontinuous" yet "electrically connected" characteristic in the fine particle film in which the particles may be of a wide variety of materials, including semiconductor silicon. Further, U.S. Pat. No. 5,679,043 discloses a flat cathode field emitter using an emitter layer having conducting-insulating interfaces from which electrons can be emitted via a "hopping conduction" phenomenon when a voltage across the interfaces is applied. Use of a non-homogeneous low effective work function material such as a cermet or amorphic diamond for the insulating portion(s) of the flat cathode emitter film is described. However, the cost effectiveness of flat film surface conduction cathode emitters can still be improved; and the prior art has yet to satisfactorily address mechanisms for switching the proposed flat surface emitter structures between on and off states of emission, or for otherwise controlling the electron emissions to vary the brightness or gray scale of light emitted by an associated cathodoluminescent FED device. Ideally, electron emissions should be controllable by low voltage level signals capable of being switched at high speeds, as opposed to the much higher anode to cathode voltages generally required to accelerate electrons to bombard the display phosphors at cathodoluminescent energy levels.

While the FED technology holds out many promises, existing designs are not without drawbacks. Extensive research and development has been devoted to FEDs in recent years, and yet problems remain unsolved. It was against this background that the present invention has been conceived.

OBJECTS OF THE INVENTION

It is accordingly an object of this invention to provide a low cost, high efficiency field emission display having the superior optical characteristics generally associated with the traditional CRT technology, in the form of a digital device with flat panel packaging.

Another object of the invention is to provide a field emission display device, for either monochrome or full color applications, with improved light conversion efficiencies.

Another object of the invention is to provide a field emission display device with a flat surface emitter that avoids yield problems and high manufacturing costs associated with microtip cathode emitters.

Another object of the invention is to provide a lower cost field emission display device that efficiently operates under the principle of surface conduction electron emission.

Another object of the invention is to provide an improved surface conduction cathode emitter structure comprised of a field effect transistor for electrically gating an emitter surface element and thus activating, deactivating or otherwise controlling the primary source of electron emissions.

SUMMARY OF THE INVENTION

The invention has particular application to field emission display (FED) devices having a faceplate electrically biased as an anode with respect to a flat film surface conduction cathode emitter, and a light emitting layer of cathodoluminescent material for bombardment by electrons resulting from operation of the cathode emitter. The cathode emitter structure can include an electron emissive layer that is also the gated channel layer of an "upside down" field effect transistor having a control gate electrode below the channel layer's surface. Thus, a variable voltage source can be applied to the transistor's gate electrode causing an electric field that controls the conductivity of the channel layer, thereby activating, deactivating or otherwise controlling the level of electron emissions from the cathode emitter structure.

In one embodiment, the transistor can be a thin film field effect transistor, e.g., in which the emissive layer or channel is on the order about 100 Angstroms thick, and the channel is conventionally inverted by the field applied by the gate electrode to vary the conductivity within the channel. In another embodiment, a thicker two-tiered transistor structure can be used, e.g., where the channel is on the order of about 500 to 5,000 Angstroms thick, and a negative applied gate voltage has the effect of repelling electrons deep within the channel and pushing them to the channel surface. The channel thus conducts current in the manner of a thin film at its surface and a ready supply of electrons is provided for surface conduction emissions.

Particularly where n-p-n type transistor structures are used, electron blocking junction elements can be incorporated on either side or both sides of the channel, to ensure against unwanted anode currents due to forward biasing of the transistor junctions by the anode to cathode acceleration potential being continuously applied while the emitter is supposed to be in a deactivated state. When used, the electron blocking junction elements can be positioned over a widened gate electrode such that they are commonly gated along with the channel to respond to a single control voltage input to the gate electrode.

Advantageously, the electron emissive layer in flat film surface conduction cathode emitter structures can be fabricated from polycrystalline materials, such as polysilicon, in which the grain boundaries naturally form dislocation sites for electron emissions. Doping of the emissive layer by ion implantation can further condition the emissive layer surface and provide such dislocation sites as well, also allowing amorphous materials or single crystal materials such as single crystal silicon to be used. Such materials allow for a very low cost of manufacturing using conventional semiconductor processing techniques for fabrication of the disclosed transistor-emitter structures as well as other types of flat film surface conduction cathode emitters.

Further, flat film surface conduction cathode emitters can advantageously incorporate a thin near mono-molecular film of a high secondary electron emission material on the surface of the electron emissive layer, to generally enhance the level of electron emissions from the emitter.

The above-mentioned and other objects, features and advantages of the invention will become apparent from the further descriptions and the attached drawings.

DETAILED DESCRIPTION OF THE PRESENTLY PREFERRED EMBODIMENTS

Figure 1:
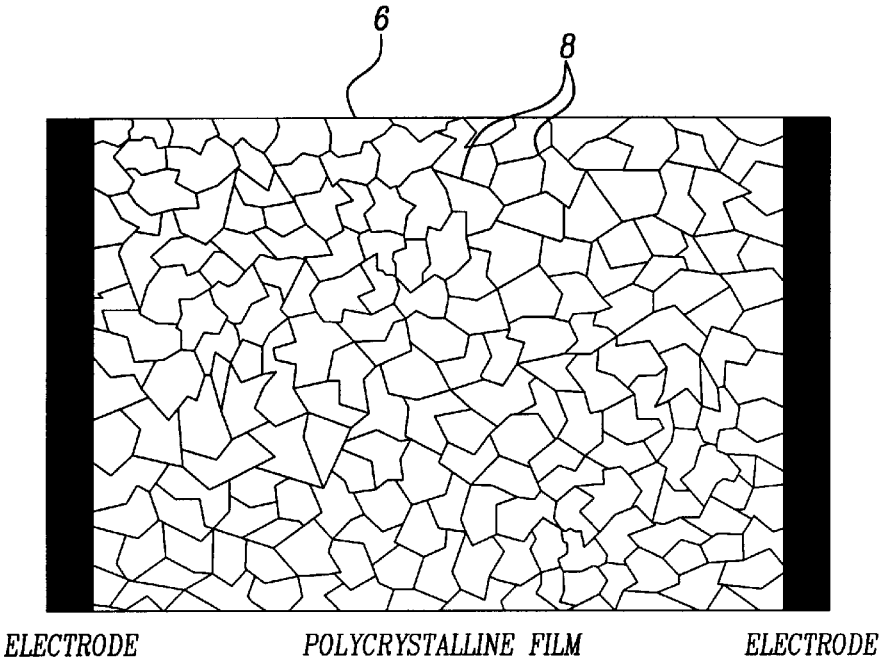
FIG. 1 is a diagram showing the grain boundaries of a polycrystalline material used as a surface conduction cathode emitter in a field emission display device.

FIG. 1 illustrates a thin amorphous or polycrystalline film 6 that may be used as a cathode electron emitter when placed adjacent to an anode structure with a high positive electrical field. Generally, surface conduction electron emission occurs when a current is passed through polycrystalline film 6, and electrons are released from the defects, dislocations or grain boundaries 8 formed on or near the surface of the polycrystalline film 6, e.g., in response to the electric field of an applied anode to cathode potential. The released electrons are directed toward the anode (not shown) which is positively charged with respect to this electron emitting film surface at a cathode potential. For example, with one milliampere (e.g., at an applied voltage of 15 volts) flowing through the film and one kilovolt being applied between anode and cathode emitter, the resulting anode current can be approximately two microamperes. In other words, depending upon the fabrication of the emitter structure, the anode current is estimated to be approximately 0.2% of the film current. In the present invention, polysilicon or other known polycrystalline material may be used for the electron emissive layer of the surface conduction cathode electron emitter. The grain boundaries of such materials provide structural discontinuities or dislocation sites from which electron emissions can be generated. In addition, conditioning of the electron emissive layer by ion implantation can similarly provide dislocations or electron emission sites in single crystal as well as polycrystalline materials. In other words, for example, a silicon electron emissive layer could be fabricated from ion implanted semiconductor polysilicon or single crystal silicon. In the case of polysilicon, ion implantation provides additional defects at the implantation sites in the surface of the polycrystalline material, such that the additional defects will increase the efficiency of the surface conduction electron emissions. Using ion implantation to dope the material to form p-type or n-type semiconductor not only conditions the material for electron emissions, it also conditions it for use as a channel layer in a controlling field effect transistor such as will be described.

Figure 2:
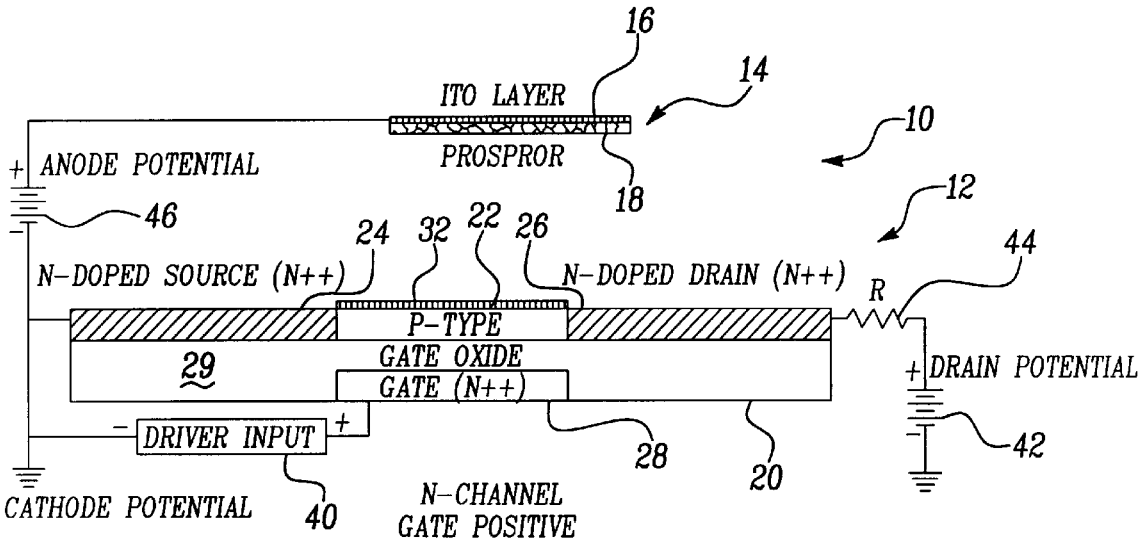
FIG. 2 is a cross sectional schematic view of an exemplary field emission display device comprised of an electrically gated thin film n-p-n transistor having a flat film of polycrystalline material forming the channel layer of the transistor.

A field emission display (FED) device 10 is schematically depicted in FIG. 2 as having a flat surface cathode emitter 12 which uses cathodoluminescence of a light emitting layer 18 as a principle of operation. Generally, the cathode emitter 12 may be opposed by a phosphor-coated, transparent faceplate (not shown) that serves as an anode 14 and has a positive voltage 46 relative to the cathode emitter 12. The FED device 10 can incorporate a transparent conductive layer 16 such as indium tin oxide (ITO), applied to the inside surface of the faceplate, or between the faceplate and a phosphor coating 18, to provide connection for the applicable anode electrode biasing or electron acceleration potential 46 with respect to the cathode emitter 12. The phosphor coating 18 may be masked or patterned on the faceplate to provide a matrix of x-y addressable pixels, with addressing provided via a selective cathode emitter activation within an array of cathode emitters 12.

Figure 3:
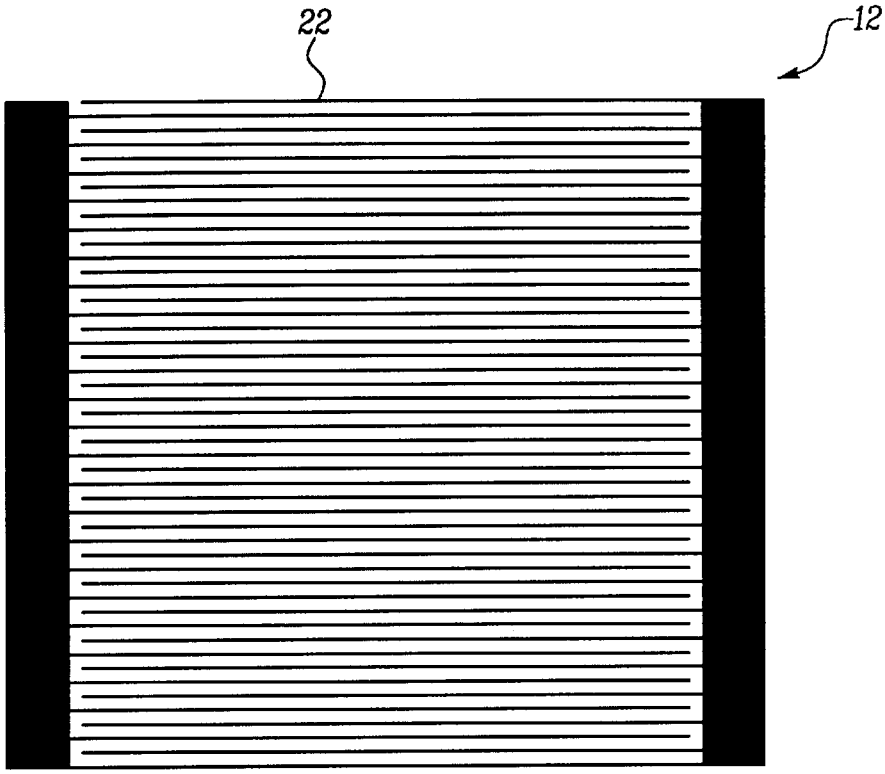
FIG. 3 is top view of a surface conduction cathode emitter deposited onto a substrate in an interdigitated pattern.

Cathode emitter 12 in FIG. 2 is a flat surface conduction emitter structure preferably comprised of a flat film of polycrystalline semiconductor material that is fabricated as part of a thin film field effect transistor 20. The thin film transistor 20 is built "upside down" on a suitable substrate and preferably can be fabricated from silicon, amorphous silicon or polysilicon material. By building the transistor "upside down", the gated channel layer 22 of transistor 20 provides an exposed or uncovered surface of polycrystalline or single crystal material that may be doped by ion implantation and used as the electron emissive surface for surface conduction electron emissions. The transistor 20 is called "upside down" to contrast with the more common field effect transistor structures in which the transistor gate is fabricated over top of the channel area on a substrate. As shown, the channel layer 22 is disposed between a source element 24 and a drain element 26 of the transistor 20. A gate element 28 for transistor 20 is disposed below channel layer 22 opposite its exposed electron emissive surface, and can be a conventional field effect transistor type gate, such as one constructed from either a metal or silicon layer separated from the channel layer 22 by an electrically insulating oxide 29. To further extend this cathode emitter structure, the channel layer could be disposed onto a substrate in an interdigitated pattern as shown in FIG. 3. The channel layer 22 may also be formed using other various patterns, including but not limited to serpentine, comb or spiral patterns (not shown). In addition, multiple gates may be fabricated on each transistor, e.g., by using a "finger type pattern".

Referring to FIG. 2, the top exposed surface of polycrystalline material of channel layer 22 becomes an electron emitting area when the transistor is turned on (i.e., activated). When FED 10 is operational, electrons can easily flow from the inverted p-type silicon channel layer 22 (which becomes n-type when the transistor is conducting) to the anode 14. In other words, an anode current flows from the anode 14 into channel layer 22 of cathode emitter 12, while electrons flow from cathode to anode. A path for the anode current is provided by channel layer 22 being electrically coupled to a cathode potential (e.g., ground) through source element 24. A drain voltage source 42, e.g., on the order of about 5–7 volts, can be electrically coupled to the channel layer 22 through a load 44 in series with drain element 26. Drain voltage 42 provides a potential for the film current that is forced to flow through gated channel layer 22 and in parallel with its exposed surface of polycrystalline material, thus causing surface conduction in the polycrystalline material. To activate this surface conduction effect, a gate potential, e.g., on the order of about 2–5 volts, can be applied by a variable voltage source 40 to gate element 28. Since the conductivity of channel layer 22 is a function of the gate potential, more electrons are emitted from channel layer 22 as the gate potential is increased, thereby increasing film current flowing through and in parallel with channel layer 22 from drain 26 to source 24. Thus, the transistor based emitter structure of the present invention provides a simple and effective means for electrically gating channel layer 22, thereby controlling electron emissions from cathode emitter 12.

In an operational FED 10, the emitted electrons are accelerated toward the anode 14 to bombard the intervening light emitting layer or phosphors 18. Phosphors 18 are in turn induced into cathodoluminescence by the bombarding electrons, thus emitting light through the faceplate (not shown) for observation by a viewer. The operational potential is applied by an anode voltage source 46 that is electrically connected to provide the anode to cathode potential, which can generally be on the order of 500 to 1000 volts for FEDs using high-voltage, sulfur-based phosphors. It should also be noted that variable voltage source 40 can be modulated (e.g., by amplitude, duty cycle or pulse width) to control the gray scale and/or brightness of light being emitted by the light emitter layer 14 when the device is activated.

For FEDs using high voltage phosphors, it is presently preferred that the anode-emitter capacitance be less than one forth the capacitance across the length (distance from source to drain) of the transistor channel layer 22. This relationship between capacitances can be achieved, for example, by controlling the length of the transistor channel for a given anode to emitter spacing, to allow for proper activation and deactivation of the device. The reason for the attention to capacitance is because of the sharp turn-on characteristic curve that can be applicable when high voltage is applied between field emitters and the anode. Current is practically non-existent until a "breakdown" voltage is reached, and at this point, current rises sharply. If the capacitance is not within an operational range, source to drain shorting or breakdown of the transistor can occur. Therefore, capacitance between the cathode and anode should preferably be less than one-fourth the capacitance across the length of the channel layer, for use in FEDs using high voltage phosphors or other cathodoluminescent materials having a comparable turn-on characteristic curve.

Figure 4:
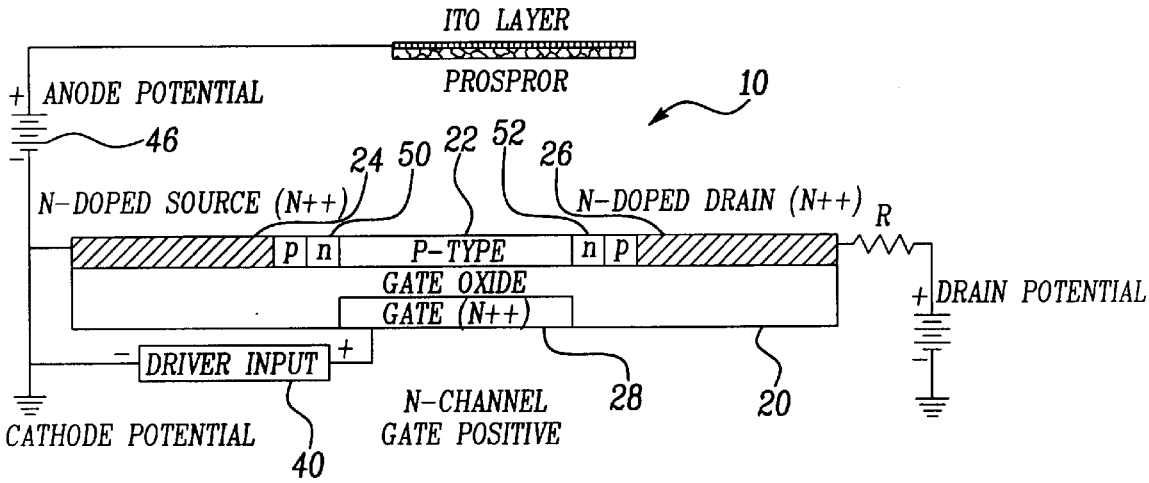
FIG. 4 is a cross sectional schematic view of an exemplary field emission display device incorporating electron blocking junctions into an electrically gated thin film n-p-n transistor.

As shown in FIG. 4, bi-polar electron blocking structures made of semiconductor material can be incorporated into FED 10 to prevent conductivity when the device is in a deactivated state. A first p-n semiconductor electron blocking junction 50 is placed in series between the source element 24 and the channel layer 22, and a second p-n semiconductor electron blocking junction 52 is placed in series between the drain element 26 and the channel layer 22. Because both of the blocking junctions are disposed directly over the dielectrically isolated gate element 28, current flow through the device can still be controlled by a potential 40 applied to a single gate electrode 28. Use of blocking junctions 50 and 52, in conjunction with the illustrated n-p-n field effect transistor structure shown in FIG. 4, is designed to inhibit unwanted anode currents resulting from forward biasing of the transistor junctions by the anode to cathode potential when the cathode emitter is in a deactivated state. However, in a configuration using a p-n-p type field effect transistor, the drain to channel and source to channel junctions would tend to be reverse biased by the anode to cathode acceleration potential, and while electron blocking structures could also be incorporated, the need for their use is thus mitigated. To inhibit arcing and unwanted current flows, the exposed surfaces of the non-emissive transistor and/or electron blocking junctions can be covered by an oxide or other insulating layer (not shown) in all of the various transistor-emitter structures described herein.

In a presently preferred embodiment of the invention, the cathode emitter is fabricated as a thin film n-p-n transistor where source element 24, channel layer 22 and drain element 26 are of a thickness between about 100 and 150 Angstroms. The channel layer 22 can be comprised of a p-type polysilicon material lightly doped with an impurity concentration between about $5\times10^{11}/cm^3$ and $2\times10^{13}/cm^3$, whereas source element 24 and drain element 26 can be comprised of n-type polysilicon or single crystal silicon material an heavily doped with an impurity concentration between about $10^{15}/cm^3$ and $2\times10^{16}/cm^3$. Alternatively, p-n-p type "upside down" field effect transistor structures could be used, where the cathode emitter would be fabricated with an n-type central channel material having the source element and the drain element being doped with a p-type material.

Figure 5:
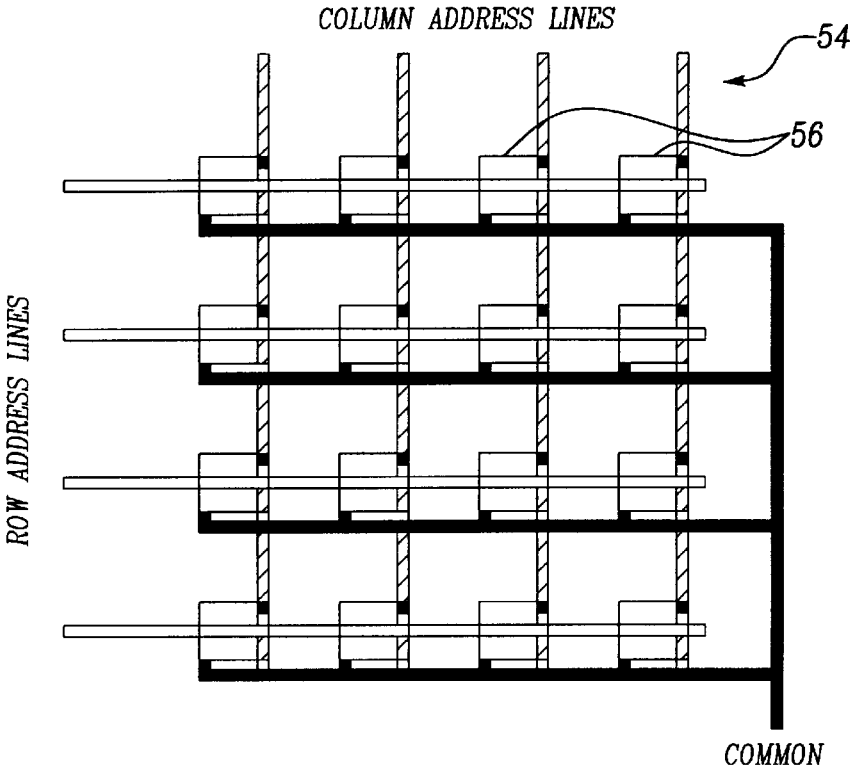
FIG. 5 is top view of an exemplary 4×4 matrix of an integrated circuit type emitter structure for use in a field emission display device.

The above described FED structures can be fabricated in an array pattern, e.g., as shown in FIG. 5. FIG. 5 shows a simple 4×4 matrix of an integrated circuit type cathode emitter structure 54 with row and column addressing lines. The transistors 56 of cathode emitter matrix structure 54 are fabricated "upside down" with their gate electrodes below their electron emissive channel layers as previously described, on the bottom of the FED device. This cathode emitter matrix structure 54 could be fabricated on a glass substrate using CVD deposition of silicon (which could be annealed or could be used as deposited). Alternatively, a similar cathode emitter structure might also be fabricated by depositing cadmium selenide, cadmium sulphide, gallium arsenide, germanium, silicon carbide or other thin film transistor material onto a substrate. Depending on the mobility requirements of the transistors for the functioning specified, a variety of thin film transistor types could be fabricated in a variety of ways for use in this invention. While the anode or light emitting layer has not been shown in FIG. 5, it is understood that it is positioned directly above the cathode emitter structures with a positive electrical potential applied to it in reference to the emitters.

Fabrication of cathode emitter structures in the above described manner can easily be accomplished at low cost using conventional integrated circuit manufacturing processes. Large area fabrication is possible using the same type of integrated circuit processing as used in active matrix LCDs, for example, or by using other known fabrication techniques. Since the electron emissive surfaces can be adequately conditioned with dislocation sites by virtue of being comprised of polycrystalline and/or ion implanted materials, special processing steps such as "electroforming" are not required.

With field effect transistor structures using this invention, gate voltages of only a few volts control electron emission from the surface conduction cathode emitter structure. Rather than simply pulling electrons from the surface of the cathode emitter by high electrical fields, electron emissions is effected by controlling the conductivity in the channel layer of the transistor so that the higher the conductivity in the channel the larger the number of escaping electrons moving towards the anode.

Figure 6:
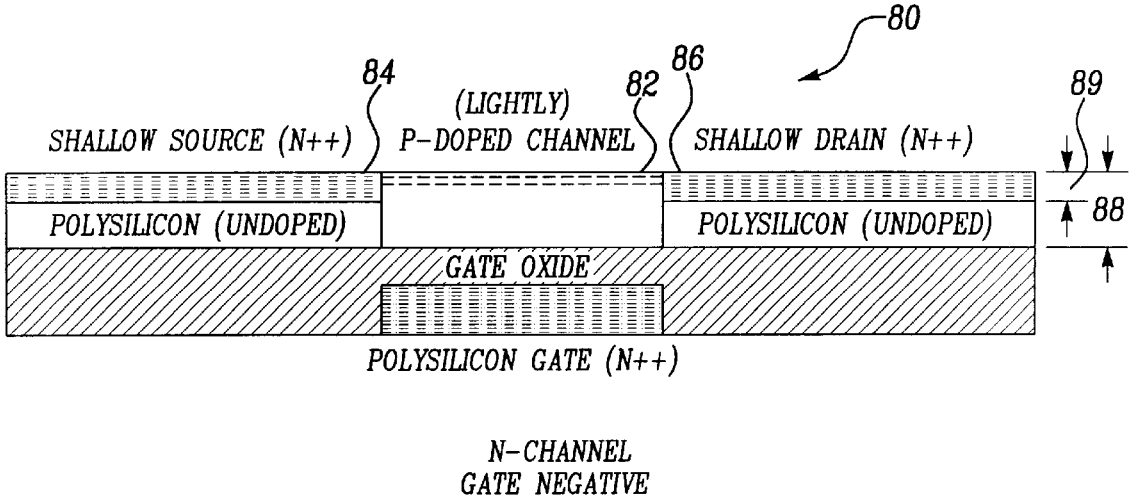
FIG. 6 is a cross sectional schematic view of an exemplary cathode emitter structure comprised of an electrically gated two tiered n-p-n transistor structure for use in a field emission display device.

A further illustrative embodiment of a transistor based surface conduction cathode emitter for use in a FED device is shown in FIG. 6. Similar to other embodiments, cathode emitter 80 is a flat surface emitter structure preferably comprised of a film of polycrystalline semiconductor material fabricated as the channel layer of an "upside down" field effect transistor, e.g., by conventional CVD processing. As shown, the exposed surface of the p-type channel layer 82 is lightly doped, e.g., with an impurity concentration between about $5\times10^{11}/cm^3$ and $2\times10^{13}/cm^3$. Channel layer 82 as well as a source element 84 and a drain element 86 can be fabricated with a thickness 88 between 500 and 5000 Angstroms. Moreover, source and drain elements 84 and 86 can include a shallow surface layer disposed on top of an undoped polysilicon layer. This shallow surface layer is fabricated, on the order of about 100 Angstroms thick (as shown in FIG. 6 at 89), from an n-type doped silicon. Alternatively, the undoped polysilicon layer could be replaced by a similarly situated layer of n-type polysilicon lightly doped to an impurity concentration between about $10^{15}/cm^3$ and $2\times10^{16}/cm^3$.

During FED operation, the two-tier structure of the transistor shown in FIG. 6 is designed to confine conduction currents to near the electron emissive surface of the cathode emitter. In general, an FED device using cathode emitter 80 operates in the previously described manner with electrons easily flowing from the inverted p-type silicon channel layer (which becomes n-type when the transistor is conducting) to the anode. However, unlike the embodiments previously described, only a top surface layer of the channel layer gets inverted to n-type and not the entire area of the channel layer. By applying a negative gate potential to this thick n-channel device, electrons are repelled deep within the channel and pushed to the channel surface. The channel thus conducts current in the manner of a thin film at its surface and a ready supply of electrons is provided for surface conduction emissions.

Normally, a positive voltage is applied to the gate electrode for an n-p-n, n-channel field effect transistor to conduct. This positive voltage pulls electrons from the channel to a gate oxide interface. In the embodiment shown in FIG. 6, a negative voltage is applied to the gate electrode. This negative voltage causes electrons in the channel to be repelled and move to the anode or top side of the channel. Since the source and drain electrodes incorporate a two-tiered structure, the pushing of electrons to the top tier region results in the entire channel surface being inverted to n-type along its top surface.

In each of the above-described embodiments, as well as other types of flat film surface conduction cathode emitters, a thin near mono-molecular film of a high secondary emission material can be deposited over the electron emissive surface to enhance electron emission from the flat film cathode emitter. For instance, a mono-molecular film 32 is shown in FIG. 2. Preferred high secondary emission materials include magnesium oxide, aluminum oxide or beryllium oxide. With a thin film of such material deposited over the electron emissive surfaces with a near monomolecular thickness (approximately 10–15 Angstroms), electron emission can be significantly enhanced.

While the presently preferred embodiments of the invention have been illustrated and described, it will be understood that those and yet other embodiments may be within the scope of the following claims.

What is claimed is:

1. In a field emission display device including a cathode electron emitter, a faceplate electrically biased with respect to the emitter and a light emitting layer of cathodoluminescent material for bombardment by electrons resulting from operation of the cathode emitter, the improvement comprising:

a field effect transistor defining the cathode emitter, said transistor having a channel layer comprised of a substantially polycrystalline semiconductor material, said channel layer having an exposed surface of said polycrystalline material that faces the light emitting layer and provides a source of surface conduction electron emissions.

2. A field emission display device, which comprises:

a faceplate through which emitted light is transmitted from an inside surface to an outside surface of the faceplate for viewing;

a cathode emitter defined by a field effect transistor having a channel layer comprised of a polycrystalline material, said channel layer having an exposed surface of said polycrystalline material that provides a source of surface conduction electron emissions;

an anode, comprising a layer of electrically conductive material disposed between the inside surface of the faceplate and the cathode emitter; and a light emitter layer of cathodoluminescent material capable of emitting light through the faceplate in response to bombardment by electrons emitted within the device, disposed between the anode and the cathode emitter.

3. The field emission display device of claim 2 further comprising a drain voltage source electrically coupled to said channel layer, whereby an electric current flows through said channel layer in parallel with the exposed surface of said polycrystalline material to generate electron emissions.

4. The field emission display device of claim 2 wherein said polycrystalline material comprises polysilicon.

5. The field emission display device of claim 2 wherein said polycrystalline material has been conditioned by ion implantation to provide structural dislocations in said polycrystalline material for said channel layer.

6. The field emission display device of claim 2 wherein said polycrystalline material has been conditioned by ion implantation to form a doped semiconductor material for said channel layer.

7. The field emission display device of claim 2 wherein said polycrystalline material has been generated from a single crystal material conditioned by ion implantation to create structural dislocations for surface conduction electron emissions from said channel layer.

8. The field emission display device of claim 7 wherein said single crystal material is silicon.

9. The field emission display device of claim 2 wherein said channel layer is disposed between a source element and a drain element, and said transistor is electrically coupled to a cathode potential through said source element, and a gate element is disposed on an opposite side of said channel layer from said exposed surface of said polycrystalline material.

10. The field emission display device of claim 9 wherein said gate element comprises a metal or silicon layer separated from said channel layer by an oxide layer for providing electrical insulation.

11. The field emission display device of claim 9 further comprising a variable voltage source electrically coupled to said gate element, wherein the electrical resistance of said channel layer varies in response to an electrical field created by said variable voltage source, thereby controlling surface conduction electron emissions from said cathode emitter, and wherein an anode voltage source is electrically coupled between said anode and said cathode emitter for applying a bias voltage.

12. The field emission display device of claim 11 wherein said variable voltage source is modulated to control at least one of gray scale or brightness of light emitted by said light emitter layer.

13. The field emission display device of claim 9 wherein the capacitance across said channel layer is the order of four times the capacitance between said cathode emitter and said light emitter layer.

14. The field emission display device of claim 9 in which a bias voltage is applied between said anode and said cathode emitter, and further including a first electron blocking junction in series between said source element and said channel layer, and a second electron blocking junction in series between said drain element and said channel layer, thereby inhibiting electron flow during deactivation of the field emission display device while said bias voltage is applied.

15. The field emission display device of claim 14 wherein said blocking junctions and said channel layer are disposed over said gate element for controlling electron emissions from said cathode emitter.

16. The field emission display device of claim 9 in which a bias voltage is applied between said anode and said cathode emitter, and further including at least one electron blocking junction disposed between said source element and said channel layer, thereby inhibiting electron flow during deactivation of the field emission display device while said bias voltage is applied.

17. The field emission display device of claim 9 wherein said transistor further comprises an n-p-n transistor, and each of said source element, said channel layer and said drain element have a thickness on the order of about 100 Angstroms.

18. The field emission display device of claim 9 wherein said transistor further comprises a p-n-p transistor, and each of said source element, said channel layer and said drain element have a thickness on the order of about 100 Angstroms.

19. The field emission display device of claim 9 wherein a negative potential applied to said gate element increases the conductivity through said channel layer and operates to push electrons to the exposed surface of said polycrystalline material for surface conduction electron emissions.

20. The field emission display device of claim 19 wherein said transistor is an n-p-n transistor, and wherein said source element and said drain element each comprises a surface layer fabricated from doped n-type silicon and a second layer fabricated from undoped polysilicon.

21. The field emission display device of claim 20 wherein said channel layer is fabricated from lightly doped p-type polysilicon, and each of said source element, said channel layer and said drain element have a thickness on the order of 500 to 5000 Angstroms, and said surface layers of said source layer and said drain layer each have a thickness on the order of about 100 Angstroms.

22. The field emission display device of claim 19 wherein said transistor is an n-p-n transistor, and wherein said source element and said drain element each comprises a surface layer fabricated from heavily doped n-type silicon and a second layer fabricated from lightly doped n-type polysilicon.

23. The field emission display device of claim 22 wherein said channel layer is fabricated from lightly doped p-type polysilicon, and each of said source element, said channel layer and said drain element have a thickness on the order of 500 to 5000 Angstroms, and said surface layers of said source layer and said drain layer each have a thickness on the order of about 100 Angstroms.

24. The field emission display device of claim 2 further comprising a near mono-molecular thin layer which overlays the exposed surface of said polycrystalline material for providing enhanced secondary emissions of electrons from said cathode emitter.

25. The field emission display device of claim 24 wherein said mono-molecular thin layer comprises one or more materials selected from the group comprising magnesium oxide, aluminum oxide and beryllium oxide.

26. The field emission display device of claim 25 wherein said mono-molecular thin layer has a thickness on the order of 10 Angstroms.

27. A field emission display device, which comprises:

a faceplate through which emitted light is transmitted from an inside surface to an outside surface of the faceplate for viewing;

a cathode emitter defined by a field effect transistor having a channel layer with an exposed surface and comprised of a polycrystalline semiconductor material, said channel layer having a variable conductivity operable to push electrons to the exposed surface of said channel layer for surface conduction electron emissions;

an anode, comprising a layer of electrically conductive material disposed between the inside surface of the faceplate and the cathode emitter; and a light emitter layer of cathodoluminescent material capable of emitting light through the faceplate in response to bombardment by electrons emitted within the device, disposed between the anode and the cathode emitter.

28. The field emission display device of claim 27 wherein said polycrystalline material is polysilicon.

29. The field emission display device of claim 27 wherein said polycrystalline material has been conditioned by ion implantation to create structural dislocations in said polycrystalline material.

30. The field emission display device of claim 27 wherein said polycrystalline material has been conditioned by ion implantation to form a doped semiconductor material for said channel layer.

31. The field emission display device of claim 27 wherein said polycrystalline material has been generated from a single crystal material conditioned by ion implantation to create structural dislocations for surface conduction electron emissions from said channel layer.

32. The field emission display device of claim 31 wherein said single crystal material is silicon.

33. The field emission display device of claim 27 further comprising a drain voltage source electrically coupled to said channel layer, whereby an electric current flows through said channel layer in parallel with the exposed surface of said polycrystalline material to generate surface conduction electron emissions from said exposed surface.

34. The field emission display device of claim 27 wherein said channel layer is disposed between a source element and a drain element, said transistor being electrically coupled to a cathode potential through said source element, and a gate element is disposed on an opposite side of said channel layer from said exposed surface thereof.

35. The field emission display device of claim 34 wherein said gate element comprises a metal or silicon layer separated from said channel layer by an oxide layer for providing electrical insulation.

36. The field emission display device of claim 34 wherein said source element and said drain element each comprise a surface layer having a thickness on the order of about 100 Angstroms and a second layer, such that electrical conduction is along the surface of said transistor, said transistor fabricated having a thickness on the order of 500 to 5000 Angstroms.

37. The field emission display device of claim 34 further comprising a variable voltage source electrically coupled to said gate element, wherein the electrical resistance of said channel layer varies in response to an electrical field created by said variable voltage source, thereby controlling surface conduction electron emissions from said cathode emitter, and wherein an anode voltage source is electrically coupled between said anode and said cathode emitter for applying a bias voltage.

38. The field emission display device of claim 37 wherein said variable voltage source is modulated to control at least one of gray scale or brightness of light emitted by said light emitter layer.

39. The field emission display device of claim 34 in which a bias voltage is applied between said anode and said cathode emitter, and further including a first electron blocking junction in series between said source element and said channel layer, and a second electron blocking junction in series between said drain element and said channel layer, thereby inhibiting electron flow during deactivation of the field emission display device while said bias voltage is applied.

40. The field emission display device of claim 39 wherein said blocking junctions and said channel layer are disposed over said gate element for controlling electron emissions from said cathode emitter.

41. The field emission display device of claim 34 in which a bias voltage is applied between said anode and said cathode emitter, and further including at least one electron blocking junction disposed between said source element and said channel layer, thereby inhibiting electron flow during deactivation of the field emission display device while said bias voltage is applied.

42. The field emission display device of claim 34 wherein said transistor further comprises an n-p-n transistor, said source element and said drain element each having a surface layer fabricated from doped n-type silicon and a second layer fabricated from undoped polysilicon.

43. The field emission display device of claim 34 wherein said transistor further comprises an n-p-n transistor, said source element and said drain element each having a surface layer fabricated from heavily doped n-type silicon and a second layer fabricated from lightly doped n-type polysilicon.

44. The field emission display device of claim 27 further comprising a near mono-molecular thin layer which overlays the exposed surface of said polycrystalline material for enhanced secondary emissions of electrons from said cathode emitter.

45. The field emission display device of claim 44 wherein said mono-molecular thin layer comprises one or more materials selected from the group comprising magnesium oxide, aluminum oxide and beryllium oxide.

46. The field emission display device of claim 45 wherein said mono-molecular thin layer has a thickness on the order of 10 Angstroms.

47. A field emission display device, including a cathode electron emitter spaced from a faceplate electrically biased as an anode with respect to the emitter and a light emitting layer of cathodoluminescent material for bombardment by electrons resulting from operation of the cathode electron emitter, wherein:

the cathode electron emitter comprises an electrically gated channel layer of semiconductor material having an exposed surface through which electrons are emitted when an electric current is made to flow through said gated channel layer and in parallel with said exposed surface thereof, to provide a source of surface conduction electron emissions from said exposed surface when the display device is activated.

48. The field emission display device of claim 47 wherein said gated channel layer is disposed in a serpentine pattern on a substrate.

49. The field emission display device of claim 47 wherein said gated channel layer is disposed in a spiral pattern on a substrate.

50. The field emission display device of claim 47 wherein said channel layer provides states of differing electrical resistance in response to the effect of an electric field applied by a gate element disposed beneath the channel layer and electrically coupled through a gate electrode to a variable voltage source, to switch said cathode electron emitter between differing states of electron emission.

51. The field emission display device of claim 47 wherein said channel layer is disposed between source and drain elements defining a thin film field effect transistor, said channel layer being electrically coupled to a cathode potential of the device through said source element, and wherein said source and drain elements are disposed in an interdigitated pattern on a substrate.

52. The field emission display device of claim 47 wherein said channel layer comprises a flat film of polycrystalline semiconductor material in which the grain boundaries at said exposed surface provide dislocations at which primary emissions of electrons are generated.

53. The field emission display device of claim 47 wherein said channel layer is conditioned by ion implantation to provide dislocations at the implantation sites at which primary emissions of electrons are generated.

54. A field emission display device, including a cathode electron emitter spaced from a faceplate electrically biased as an anode with respect to the emitter and a light emitting layer of cathodoluminescent material for bombardment by electrons resulting from operation of the cathode electron emitter, wherein:

the cathode electron emitter comprises an electrically gated channel of a thin film field effect transistor fabricated from semiconductor material on a substrate, said electrically gated channel having an exposed surface through which electrons are emitted when an electric current is made to flow from the source to the drain of said thin film field effect transistor, to provide a source of surface conduction electron emissions from said exposed surface when the display device is activated.

55. The field emission display device of claim 54 wherein said field effect transistor comprises an n-p-n transistor having an enhancement mode of operation, an applied positive voltage to the gate of said field effect transistor being operative to increase the electrical conductivity through said electrically gated channel by providing electrons into said electrically gated channel and to said exposed surface thereof.

56. The field emission display device of claim 54 wherein said field effect transistor comprises an n-p-n transistor, an applied negative voltage to the gate of said field effect transistor being operative to increase the electrical conductivity through said electrically gated channel at said exposed surface thereof by further depleting electrons within said electrically gated channel and thereby pushing electrons to said exposed surface of said electrically gated channel.

57. A cathode electron emitter device comprising an electrically gated channel of a thin film field effect transistor fabricated from semiconductor material on a substrate, said electrically gated channel having an exposed surface through which electrons are emitted when an electric current is made to flow from the source to the drain of said thin film field effect transistor, to provide a source of surface conduction electron emissions from said exposed surface when said cathode electron emitter is activated.

58. The cathode electron emitter device of claim 57 wherein said transistor has its gate disposed beneath said electrically gated channel and its source electrically coupled to the cathode potential of the emitter device, said field effect transistor providing states of differing electrical resistance between said cathode potential and said electrically gated channel, to provide a controllable source of primary electron emissions from said exposed surface when the device is activated.

59. The cathode electron emitter device of claim 58 wherein said thin film field effect transistor is fabricated from semiconductor material on a substrate, said material being selected from the group consisting of silicon, germanium, selenium, cadmium selenide, cadmium sulphide, gallium arsenide and silicon carbide.

* * * * *